US009354023B1

(12) United States Patent
Rittenhouse, Jr.

(10) Patent No.: US 9,354,023 B1
(45) **Date of Patent: *May 31, 2016**

(54) HOLDER FOR BODY MOUNTED ARMOR

(71) Applicant: James M. Rittenhouse, Jr., Pembroke Pines, FL (US)

(72) Inventor: James M. Rittenhouse, Jr., Pembroke Pines, FL (US)

(73) Assignee: National Molding, LLC., Miami Lakes, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/686,316

(22) Filed: Apr. 14, 2015

Related U.S. Application Data

(63) Continuation-in-part of application No. 14/084,983, filed on Nov. 20, 2013, now Pat. No. 9,003,947.

(51) Int. Cl.
*F41H 1/02* (2006.01)
*F41H 1/00* (2006.01)

(52) U.S. Cl.
CPC ..... *F41H 1/00* (2013.01)

(58) Field of Classification Search
CPC ..... F41H 1/02
USPC ..... 89/36.05, 36.02; 2/2.5
See application file for complete search history.

(56) References Cited

U.S. PATENT DOCUMENTS 1,091,449 A 3/1914 Westin
1,459,673 A 6/1923 Jabner
2,522,790 A * 9/1950 Johnston ..... B64D 17/32 24/647
3,200,463 A * 8/1965 Craven ..... B64D 17/38 24/645
4,413,357 A * 11/1983 Sacks ..... F41H 1/02 2/2.5
4,468,843 A 9/1984 Duclos et al.
4,507,802 A 4/1985 Small
4,673,070 A * 6/1987 Ambal ..... A45C 3/00 150/111
4,774,724 A 10/1988 Sacks
5,644,792 A * 7/1997 Tishler ..... F41H 1/02 2/2.5
5,832,573 A * 11/1998 Howell ..... A44B 11/2526 24/616
5,978,961 A 11/1999 Barker
6,154,936 A * 12/2000 Howell ..... A44B 11/006 24/615
6,487,761 B2 * 12/2002 Van Tassel ..... A44B 11/266 24/606
6,637,083 B1 * 10/2003 Howell ..... A44B 11/263 24/614
6,678,925 B1 * 1/2004 Howell ..... A44B 11/2592 24/647
6,684,404 B2 2/2004 Backner, Jr. et al.
6,685,071 B2 * 2/2004 Prather ..... A45C 15/00 2/2.5
6,892,392 B2 5/2005 Crye et al.
6,922,847 B2 8/2005 Bachner, Jr.

(Continued)

FOREIGN PATENT DOCUMENTS

WO WO2015077395 A2 5/2015

*Primary Examiner* — Michael David
(74) *Attorney, Agent, or Firm* — Malloy & Malloy, P.L.

(57) ABSTRACT

An assembly structured for removably mounting armor on a user's body in a protective orientation including a base having an inner portion and an outer portion. The inner portion is structured to retain the armor, preferably but not exclusively, in the form of an armor plate on the base in substantially facing relation to the body of the user, wherein the outer portion is disposed in overlying, covering relation to the armor. Preferably the base is formed of a rigid material and an attachment assembly is connected to the base and structured to facilitate the operative and removable mounting of the base and the armor on the user in a predetermined protective orientation. The attachment assembly may also include a plurality of connectors and a common release mechanism, wherein the base and the armor can be quickly and easily removed from its protective orientation and operative mounting on the user.

7 Claims, 9 Drawing Sheets

(56) References Cited

U.S. PATENT DOCUMENTS 6,961,957 B2 11/2005 Carlson
7,007,352 B1 * 3/2006 Hill ..... A45F 5/02 24/3.1
7,080,430 B2 * 7/2006 Wemmer ..... A41D 13/0012 24/3.7
7,155,786 B2 * 1/2007 Grimm ..... A44B 11/2592 24/647
7,251,867 B2 8/2007 Wemmer
7,424,748 B1 9/2008 McDunn et al.
7,448,116 B1 * 11/2008 Howell ..... A44B 11/2592 24/614
8,181,318 B2 * 5/2012 Anscher ..... A44B 11/2592 24/634
8,196,273 B2 6/2012 Anscher
8,209,825 B2 7/2012 Carter
8,353,065 B1 1/2013 Crye
8,365,312 B2 2/2013 Herring
D677,433 S 3/2013 Swan et al.
8,490,212 B1 7/2013 Asher et al.
8,490,256 B2 7/2013 Carter et al.
8,522,410 B2 9/2013 Parisi et al.
8,584,917 B2 11/2013 Hexels
8,713,764 B1 * 5/2014 Rittenhouse ..... A45F 5/02 24/3.11
8,732,918 B2 * 5/2014 Carter ..... C07H 1/06 24/606
9,003,947 B1 * 4/2015 Rittenhouse, Jr. ..... F41H 1/02 2/2.5
9,038,251 B1 * 5/2015 Bevilacqua ..... A44B 11/2592 24/614
2002/0092140 A1 7/2002 Van Tassel
2008/0263737 A1 10/2008 Parks et al.
2009/0117300 A1 * 5/2009 Thompson ..... A45F 5/02 428/35.2
2009/0277936 A1 * 11/2009 Rogers ..... A45F 5/02 224/191
2009/0282595 A1 11/2009 Branson et al.
2009/0307878 A1 * 12/2009 Kadas ..... A45F 5/02 24/303
2010/0235957 A1 9/2010 Dovner et al.
2010/0313392 A1 12/2010 Anscher
2011/0026123 A1 * 2/2011 Lee ..... G02B 27/1006 359/590
2011/0072566 A1 3/2011 Kovacevich et al.
2011/0113520 A1 5/2011 Dennis
2011/0120295 A1 5/2011 Carter
2011/0121043 A1 * 5/2011 Kincaid ..... F41C 33/045 224/191
2011/0162117 A1 * 6/2011 Schaffer ..... B82Y 20/00 850/6
2011/0191933 A1 * 8/2011 Gregory ..... A41D 13/0012 2/69
2012/0054993 A1 3/2012 Anscher
2012/0167267 A1 7/2012 Osman
2013/0185851 A1 * 7/2013 Nilsen ..... F41H 1/02 2/463

* cited by examiner

HOLDER FOR BODY MOUNTED ARMOR

The present application is a continuation-in-part application of previously filed, now pending application having Ser. No. 14/084,983, filed on Nov. 20, 2013 incorporated herein by reference.

BACKGROUND OF THE INVENTION

1. Field of the Invention

The present invention is directed to an assembly structured to operatively mount armor on a user's body in a predetermined protective orientation and includes a rigid material base having an outer portion disposed in overlying, covering relation to the armor retained on an inner portion of the base. An attachment assembly is mounted on the base and operatively connected to a plurality of connectors which may be quickly and substantially concurrently disposed in a release orientation for removal of the base from its protective orientation on the user.

2. Description of the Related Art

Protection of the upper torso such as, but not limited to, the area of the body between the waist and the neck and including both frontal and rear portions of the upper torso have been accomplished utilizing various types of armor or appropriate protective devices. By way of example, garments, which may be in the form of a vests, jackets or the similar type apparel may contain and support different types of armor. As such, the contained armor structures or materials are generally intended to prevent the penetration of projectiles. Such armor materials include sufficient structural integrity to prevent the penetration of such projectiles, but also must be sufficiently lightweight to be mounted on and carried by the body of the user. By way of example only, armor structure or materials may include layers of nylon ballistic fabrics overlapping small thin metal plates, reinforced plastics or a combination of such materials. These types of armor materials may be incorporated in different types of ballistic vest, jackets, etc.

Also, woven, high tensile strength fiber materials include projectile resistant and high energy absorption properties. Advantages of this type of material include the aforementioned lightweight capabilities as well as adequate protection features. Therefore, utilization of armor material which is sufficiently lightweight is important not only from a protective feature but also from the standpoint of comfort to the wearer. Also, known ballistic garments of the type described herein must have minimum levels of protection against the penetration of different types of projectiles.

However, conventional armor materials of the type described above including, but not limited to, the multiple layers of woven fabric, may have certain disadvantages and or operative weaknesses. By way of example, improper structuring including interlacing of the multiple layers can cause strain resulting in fiber breakage which in turn results in the inability to protect against the penetration of a projectile. Also, fibers in woven armor type layers must overcome a crimp factor before they can be assembled. Other armor materials include soft body materials which have been fabricated from polyethylene cloth including, but not limited to ballistic cloth structured to include unidirectional fiber arranged in layers which are appropriately cut and pressed to produce a single ply. Multiple plies of this type material can then be stacked to form the pliable armor structure. Energy which is not absorbed by conventional materials of the type set forth herein results in projectile energy being only partially absorbed. As such at least a portion of the projectile's energy is transmitted through the armor layer to the body of a wearer.

The result of such energy transference is the same as the wearer absorbing a heavy blow to the affected body part. Accordingly, important factors to be considered in the development of effective body armor include the ability to prevent penetration of a projectile as well as its ability to reduce the amount of deformation of the armor material when subjected to the force of an oncoming projectile. Other factors to be considered include the cost of the material, comfort to the wearer, techniques of construction and the overall weight of the material associated with a body mounted armor.

Additional problems and potential disadvantages associated with known body armor include its structuring in combination with or as part of a garment such as the aforementioned vest, jacket, etc. Utilization of body armor in this fashion significantly restricts the possibility of the user quickly and easily removing the body armor when desired. Such easy removal capabilities may be especially important when the user is subjected to emergency conditions and/or when the body armor is not needed.

Accordingly, there is a need in the area associated with body mounted armor, which overcomes the disadvantages and problems of the type generally recognized above. Such a preferred armor structure may be incorporated in or as part of an armor holder assembly which is not associated with vests, jackets or like garments, but may be used independently thereof. In such situations additional features of such a proposed armor holder assembly may include the provision of a quick release attachment assembly such that the armor holder assembly may be effectively and reliably mounted on or removed from the user's body. However such quick release capabilities also facilitate the rapid detachment or disposition of the armor holder assembly from its protective orientation on the body of the user to a disconnected, separated relation.

Therefore, at least one proposed feature of an improved armor holder assembly may comprise the use of a quick release connectors associated with an attachment assembly, which also includes an effective structure and feature for concurrently disconnecting the attachment assembly from the body of the user. Accordingly, when utilizing the improved and proposed armor holder assembly quick release buckle assemblies are not only a convenience but a necessity in certain emergency applications.

SUMMARY OF THE INVENTION

The present invention is directed to an assembly for operatively mounting armor on a user's body in a predetermined protective orientation relative to an intended portion of the body. As such, the armor holder assembly includes a base preferably formed of a rigid material such as, but not limited to, a hard plastic. In addition, the material from which the base is formed is preferably sufficiently lightweight to eliminate or significantly reduce any discomfort or limited movement of the user when the base is operatively mounted thereon. It should be noted that the rigid material from which the base is formed is not limited to a hard plastic material but may be formed from a variety of different materials, which are preferably at least partially resistant to the penetration of ballistics or projectiles and are sufficiently lightweight and sufficiently rigid to at least partially protect the armor structure from breakage, cracking or similar type damage prior to an encounter with a projectile, etc.

As will be explained in greater detail hereinafter, the armor structure may be in the form of a ceramic composite material commonly known as "SAPI". While normally effective against the penetration of projectiles, such material is considered to be somewhat fragile due at least in part to the fact that portions of the "SAPI" material comprise a ceramic based composition. As such, inadvertent trauma, such as dropping the armor structure formed from this material, could result in its breakage, cracking or other type damage that renders it less effective as a ballistic or projectile resistant material. Therefore, the base, including an outer portion, at least part of an inner portion as well as a cover structure disposed in overlying relation to the inner portion and armor structure, should have sufficient rigidity to protect the armor structure from breakage or like damage due to inadvertent trauma, unrelated to its encounter with a penetrating projectile.

More specifically, the base of the armor holder assembly may have a generally "shell-like" construction including an outer portion and an inner portion. Moreover, in at least one preferred embodiment of the present invention, the aforementioned "shell-like" construction may be further defined by the provision of a cover structure. When utilized, the cover structure is disposed in connected, at least partially overlying and or covering relation to the inner portion as well as the armor structure connected to or retained on the base by the inner portion. Further, the outer portion of the base and the cover structure may be disposed and structured to collectively and at least partially enclose the armor structure there between and at least partially within the inner area of the base between the outer portion of the cover structure. As also set forth above, the cover structure is preferably formed from a rigid material which may include a rigid plastic material or an "armor composite" material. This latter material may comprise a combination and/or composite of material(s) which is at least partially resistant to projectile or ballistic penetration.

In order to further provide for the intended and operative mounting of the armor structure at least partially within the base, such as between the outer portion and the cover structure, the outer portion may have a somewhat outwardly protruding configuration. In cooperation there with, the inner portion of the base is disposed, dimensioned and structured to support and retain the armor structure on the base. It should be also noted that while the armor structure may include a variety of different structural and operative features as set forth above, it should be resistant to the penetration of projectiles including, but not limited to, the type used with rifles and hand guns.

Accordingly, the armor structure may be in the form of a one-piece or multi-piece rigid armor plate extending over substantially all or at least a majority of the inner portion of the base. As such, the armor structure is dimensioned and configured to adequately and appropriately assume the aforementioned protective orientation relative to an intended portion of the body with which it is associated. Further, the outer portion of the base is cooperatively dimensioned, configured and disposed so as to overlie, cover and/or at least partially enclose the armor plate or structure. In order to facilitate the operative mounting of the base and the retained armor on the body of the user, the inner portion may comprise an at least partially recessed cavity or other appropriate structure dimensioned and configured to retain be armor plate or structure on the base. Therefore, when operatively mounted on the user's body the armor structure as well as the base is disposed in the intended protective orientation.

Accordingly, in at least one embodiment, the holder assembly may include the inner portion of the base specifically including, but not limited to, the recessed cavity being dimensioned and configured to at least partially receive and retain the armor plate or structure at least partially within an interior of the base. When in this interior recessed position, the armor plate or structure is still covered and/or at least partially enclosed by the outer portion of the base and the cover structure when used. As a result, the comfort and freedom of movement of the user will not be affected while the armor holder assembly is operatively mounted on the user's body. In more specific terms, the inner periphery of the recessed cavity may substantially correspond in configuration and dimension to at least a portion of the outer periphery of the armor plate or structure. Further, the cavity, when formed in the base, may be recessed inwardly therein a sufficient degree to facilitate the disposition of the armor plate at least partially within the interior of the base, while still being covered by the outer portion.

Additional features of the armor holder assembly of the present invention include the provision of an attachment assembly. The attachment assembly preferably comprises a plurality of connectors disposed on the base in appropriate locations to facilitate the attachment of the base to mounting straps, belts, harnesses, etc. Further, the plurality of connectors are structured for removably securing the base and the retained armor in the protective orientation relative to a predetermined portion of the user body. Accordingly, the plurality of connectors are preferably disposed in spaced relation to one another such that the belt, straps, etc., associated with the uniform, combat gear or other apparel or garments of the user, may be attached thereto in a stable and secure manner.

Moreover, at least some or all of the plurality of connectors may be structured to have "quick-release" capabilities, which facilitate the rapid and easy removal of the base and retained armor from its operative mounting on the user. In combat or other situations where body armor is used, situations commonly occur which require the rapid and efficient removal of the body armor from the user. Accordingly, at least some or preferably all of the plurality of connectors may include the quick release structure of the type disclosed in U.S. Pat. No. 9,038,251 to the inventor herein. This type of quick release connector is applicable for use with the armor holding assembly of the present invention. However, other connectors, which may or may not have quick release capabilities, may also be used to facilitate the attachment and removal of the base and armor from the intended operative mounting on the user body.

However, when the quick release capabilities of the attachment assembly are included, additional features may be incorporated in one or more embodiments of the armor holding assembly of the present invention. More specifically, a release assembly may be operatively connected to the plurality of connectors and may include a common release mechanism. The common release mechanism may be quickly and easily manipulated by the user, or other individual to substantially concurrently dispose each or at least some of the plurality of connectors in a release orientation. Such a release orientation will serve to disconnect each of the plurality of connectors from the associated belts, straps, harness, gear, etc. to which the base is attached on the user's body. In more specific terms, interconnection of the common release mechanism to each of the plurality of connectors may be accomplished by a plurality of cables, cords or other appropriate structures capable of operatively connecting the common release mechanism to of each of the plurality of connectors. Accordingly, in use the pulling or exertion of other predetermined directional forces on the release mechanism will serve to operate the interconnecting cables, cords etc. so as to substantially concurrently dispose each of the connectors in the aforementioned release orientation. As a result the base and the retained armor will be quickly and almost instantaneously released from its operative mounting on the user and removed from its protective orientation.

As set forth above, the dimension, configuration and overall structure of the armor holder assembly of the present invention is intended to protect at least one predetermined portion of the user's body. Accordingly, in at least one preferred embodiment the dimensions and configurations of the base and the retained armor plate or structure are intended to be disposed in overlying, protective relation to either a frontal portion or chest area of the upper torso of the user's body or the rear portion or back thereof. Moreover, the versatility of the structure and operative features of the armor holder assembly of the present invention facilitate the use of two such armor holder assemblies. As such, when two such armor holder assemblies are utilized each may be disposed in overlying, protective relation to a different one of the frontal and rear portions of the upper torso of the user body. When so utilized, the attachment assembly, comprising the plurality of connectors may be removably secured to a variety of different shoulder straps, waist belts, or other harness components which allow for the use of two such armor holder assemblies each disposed in a protective orientation with different portions of the user's body, as generally described.

These and other objects, features and advantages of the present invention will become clearer when the drawings as well as the detailed description are taken into consideration.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As clearly represented in the accompanying drawings, the present invention is directed to a holder assembly for armor, generally indicated as 10, which is mounted on the body of a user. More specifically, the holder assembly 10 comprises a base, generally indicated as 12, structured to include an outer portion 16 and an inner portion 18, wherein the inner portion 18 is represented in FIGS. 3 and 4.

Figure 5:
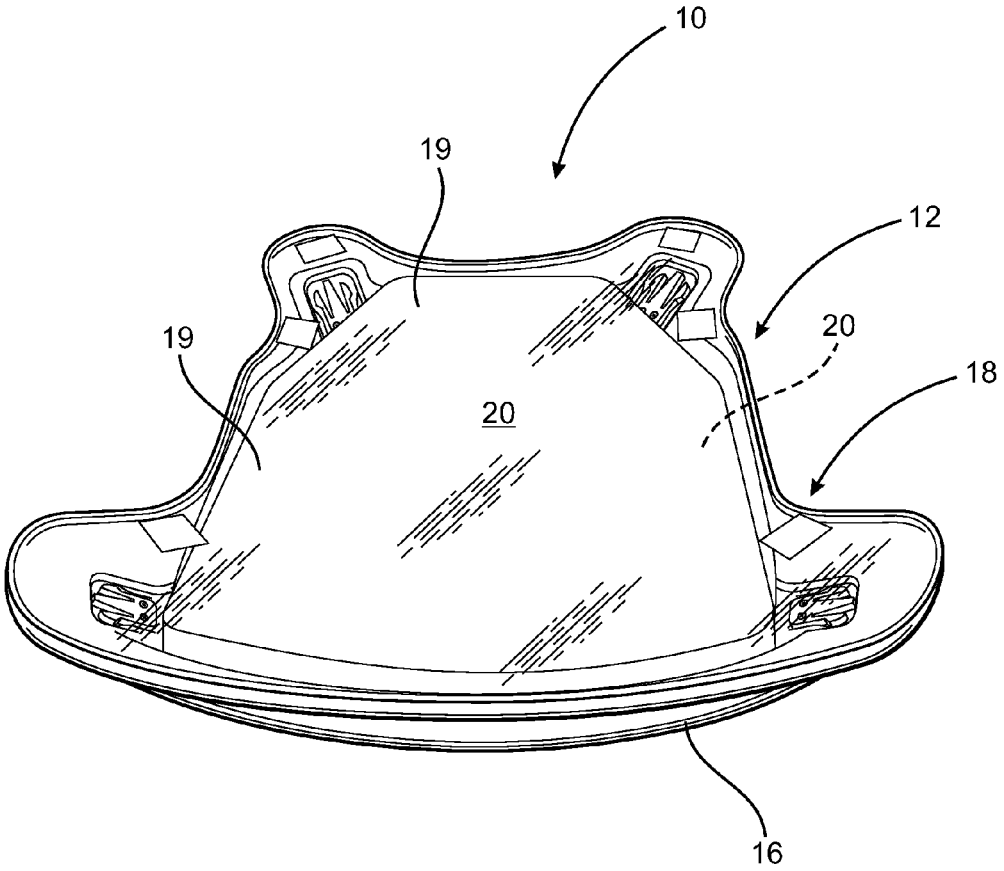
FIG. 5 is a rear perspective view of the embodiment of FIGS. 1-4 in a partially assembled state representing an attachment assembly and release mechanism associated therewith.
Figure 6:
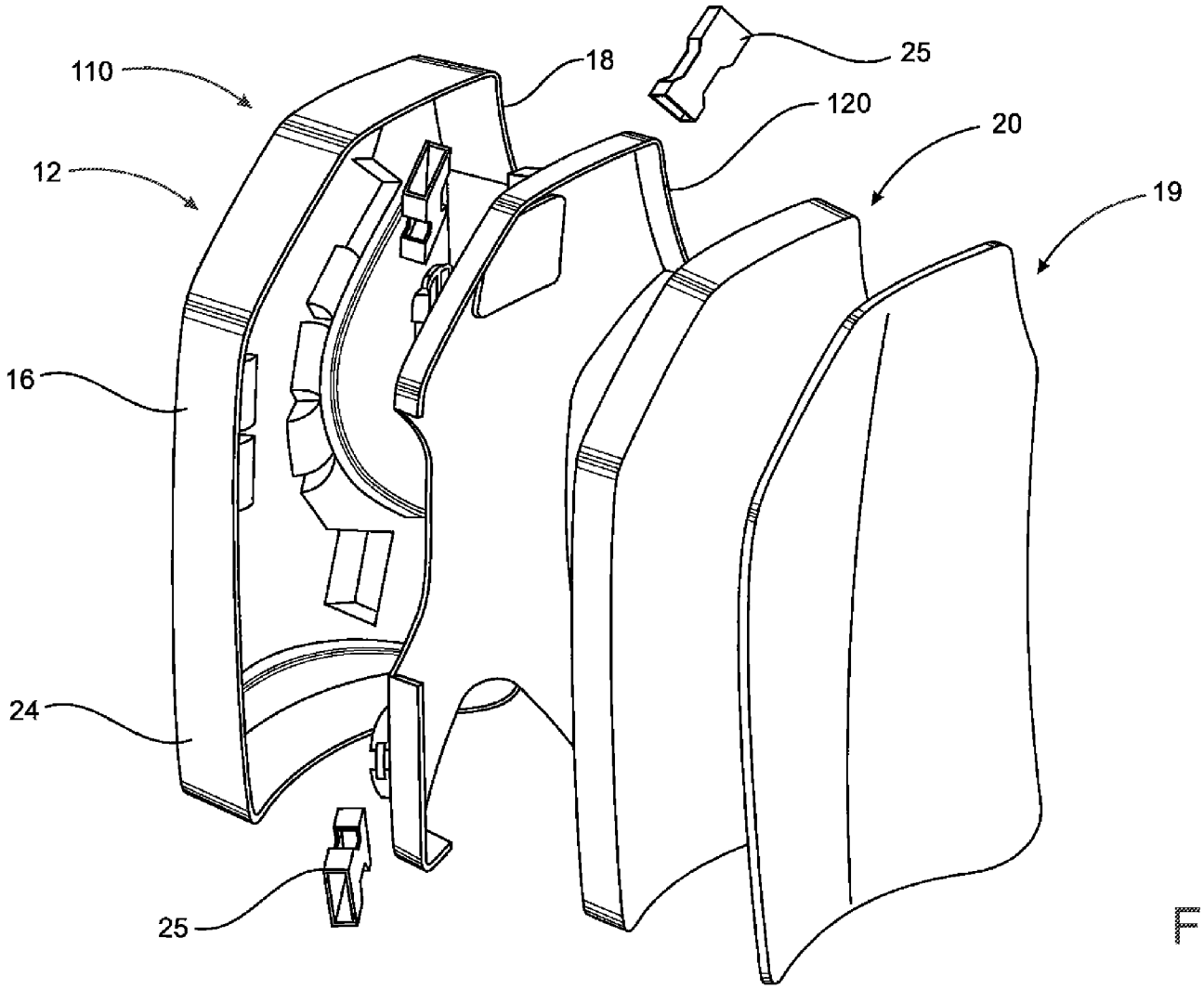
FIG. 6 is a composite perspective view of another preferred embodiment of the armor holder assembly of the present invention.

Also, as represented in FIG. 5, a cover structure 19 may be connected to the base 12 and more specifically to the inner portion 18 thereof, in overlying at least partially covering relation to an armor structure 20 retained on the base 12 at least partially by the inner portion 18. Further, the base 12 includes, but is not limited to, the outer portion 16 and the cover structure 19 being formed from a hard, rigid material such as, but not limited to, a rigid plastic, rigid armor composite or other appropriately rigid, lightweight material. As set forth above, the rigid material from which the base is formed is not limited to a hard plastic material but may be formed from a variety of different materials, which are preferably and at least partially resistant to the penetration of ballistics or projectiles. Further, the material(s) from which the base 12, cover structure 19, etc. are formed should be sufficiently rigid to at least partially protect the armor structure from breakage, cracking or similar type damage prior to an encounter with a projectile. Additional characteristics of the material from which the base 12 is formed include a generally high strength material which is sufficiently light in weight to be mounted on and carried by the body of a user without adding to the discomfort of the user or restrict his/her movement, when the base 12 is disposed in an operative position.

Figure 3:
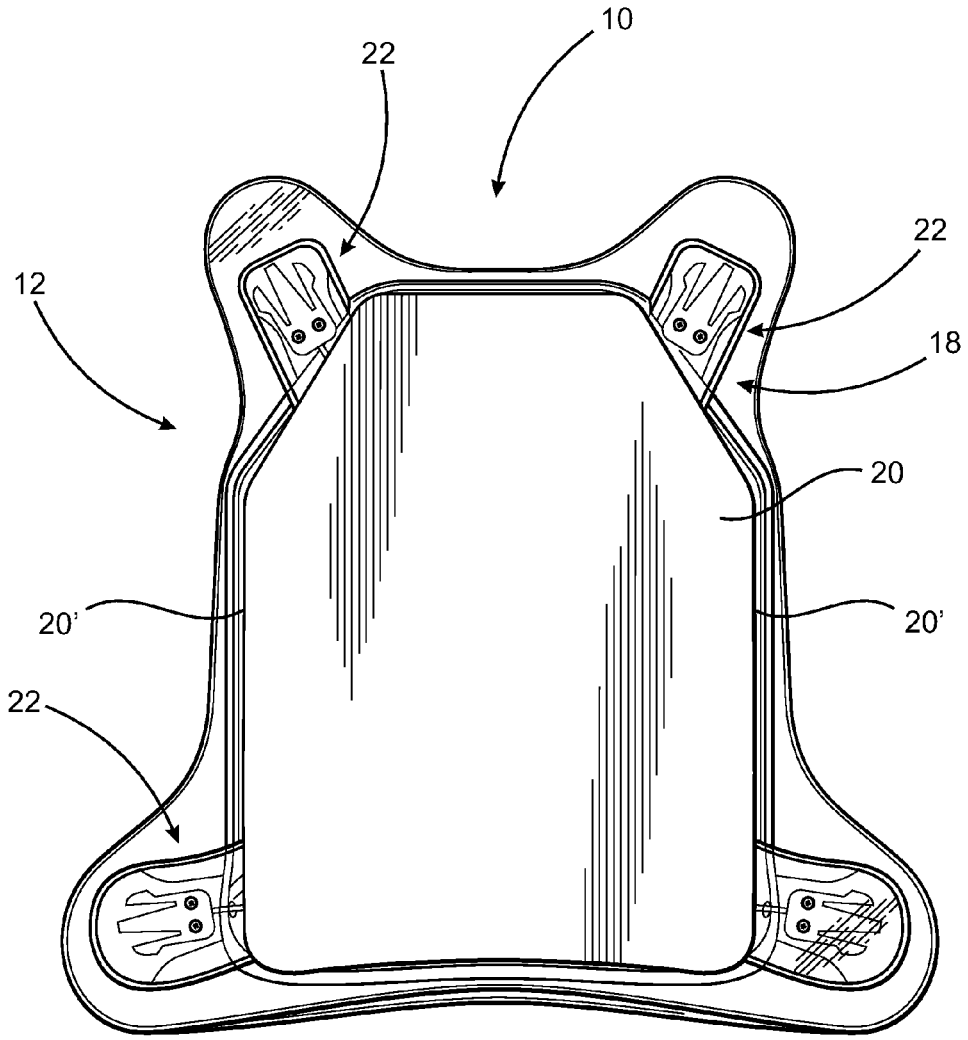
FIG. 3 is a rear perspective view of the embodiment of FIGS. 1 and 2 in a partially assembled state, representing the armor structure retained on an under portion of the base thereof.
Figure 4:
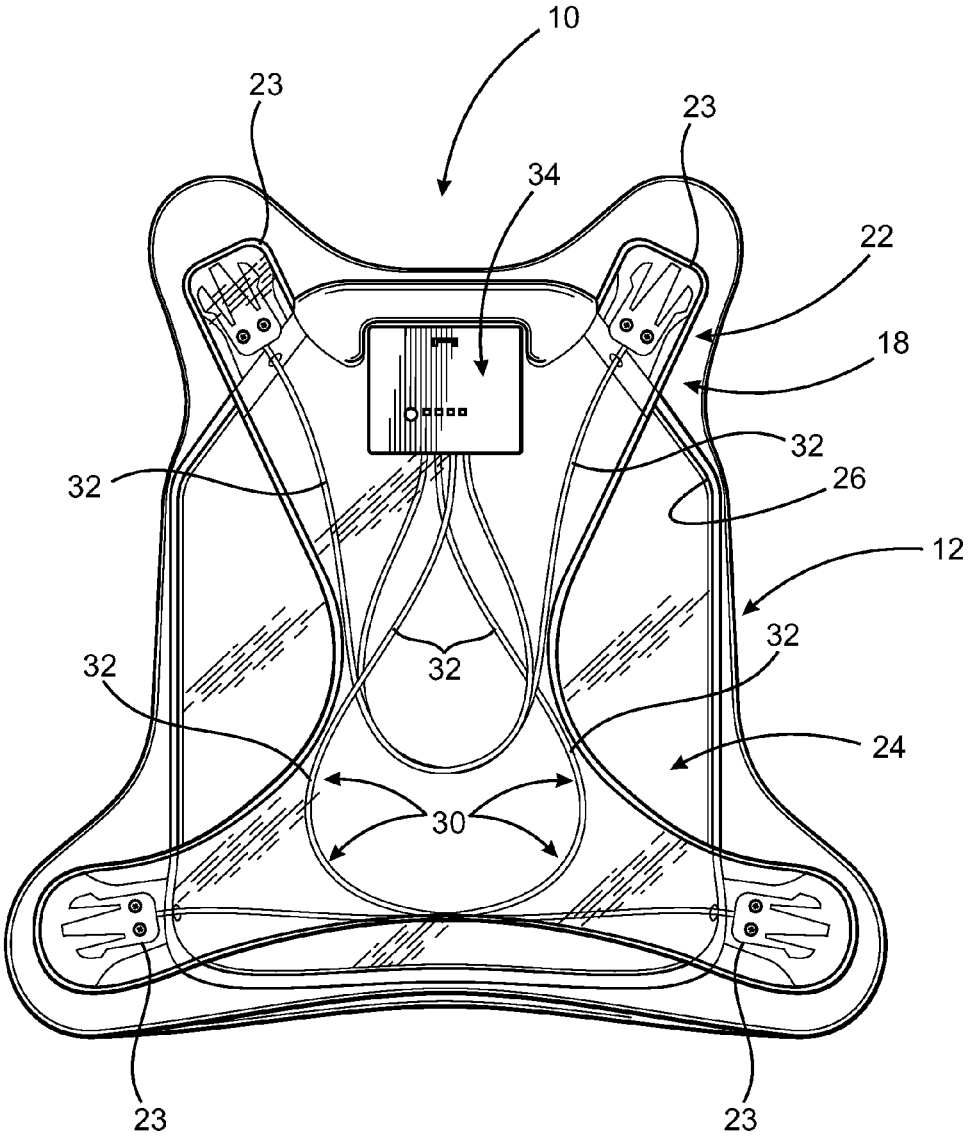
FIG. 4 is a rear elevation view of interior portions of the embodiment of FIGS. 1-3.

As represented in FIG. 3, the inner portion 18 of the base 12 is dimensioned, configured and structured to support and retain the armor structure 20 on the base 12. Further, the armor structure 20 may be in the form of a one-piece armor plate which, as set forth in greater detail hereinafter, may be correspondingly dimensioned and configured to at least a partially conform to the inner portion 18 so as to be effectively retained on the base 12. As also indicated herein, the armor structure 20 may be in the form of a single, rigid, one-piece armor plate comprising a ceramic composite material commonly known as "SAPI". While normally effective against the penetration of projectiles, such material is considered to be somewhat fragile due at least in part to the fact that portions of the "SAPI" material comprise a ceramic based composition. As such, inadvertent trauma such as, but not limited to, dropping the armor structure 20 formed from this material, could result in its breakage, cracking or other type damage that renders it less effective as a ballistic or projectile resistant material. Therefore, the structure of the base 12, the outer portion 16, the an inner portion 18, as well as a cover structure 19 are cooperatively and relatively disposed in a "protective" relation to the armor structure 20 and should have sufficient rigidity and/or other physical characteristics to protect the armor structure 20 from breakage, cracking or like damage due to inadvertent trauma, unrelated to its encounter with a penetrating projectile.

In addition, the inner portion 18 of the base 12 is also structured, dimensioned and configured to retain armor structures having different physical characteristics, other than a one-piece rigid construction. Therefore, the armor structure 20 may be in the form of one or more interconnected segments each being formed of a substantially rigid material. Alternatively, the armor structure 20 may be in the form of other structures, which are also dimensioned and configured to at least partially correspond to parts of the inner portion 18 so as to be comfortably disposed, relative to the body of a user. Therefore, as represented, the exterior portion 16 is exteriorly exposed substantially in its entirety and is dimensioned and configured to overlie and cover the armor structure 20, regardless of its physical characteristics, as well as the inner portion 18. As should also be apparent, the outer portion 16 and the cover structure 19 are cooperatively disposed and structured to collectively and at least partially enclose the armor structure 20. Therefore, when operatively mounted on the body of the user, the armor structure 20 and the inner portion 18 may be accurately described as being disposed in a "protective orientation", relative to an upper torso or other intended portion of the body of the user.

In at least one preferred embodiment, the armor holder assembly 10, specifically including the base 12 is dimensioned and configured to overlie and be disposed in the aforementioned "protective orientation" relative to either a frontal portion or a rear portion of the upper torso of the user. In addition, while only a single armor holder assembly 10 is represented in the accompanying Figures, an attachment assembly generally indicated as 22, may be used to secure one or two bases 12 of correspondingly different holder assemblies 10 in a manner which protects both the majority of the frontal portion or chest of the upper torso, as well as the rear portion or back of the upper torso. However, it is further noted that the overall dimension and configuration of the armor holder assembly 10 of the present invention may be such that the base 12 and the operative components associated therewith may be structured to cover different and or additional body parts.

Figure 1:
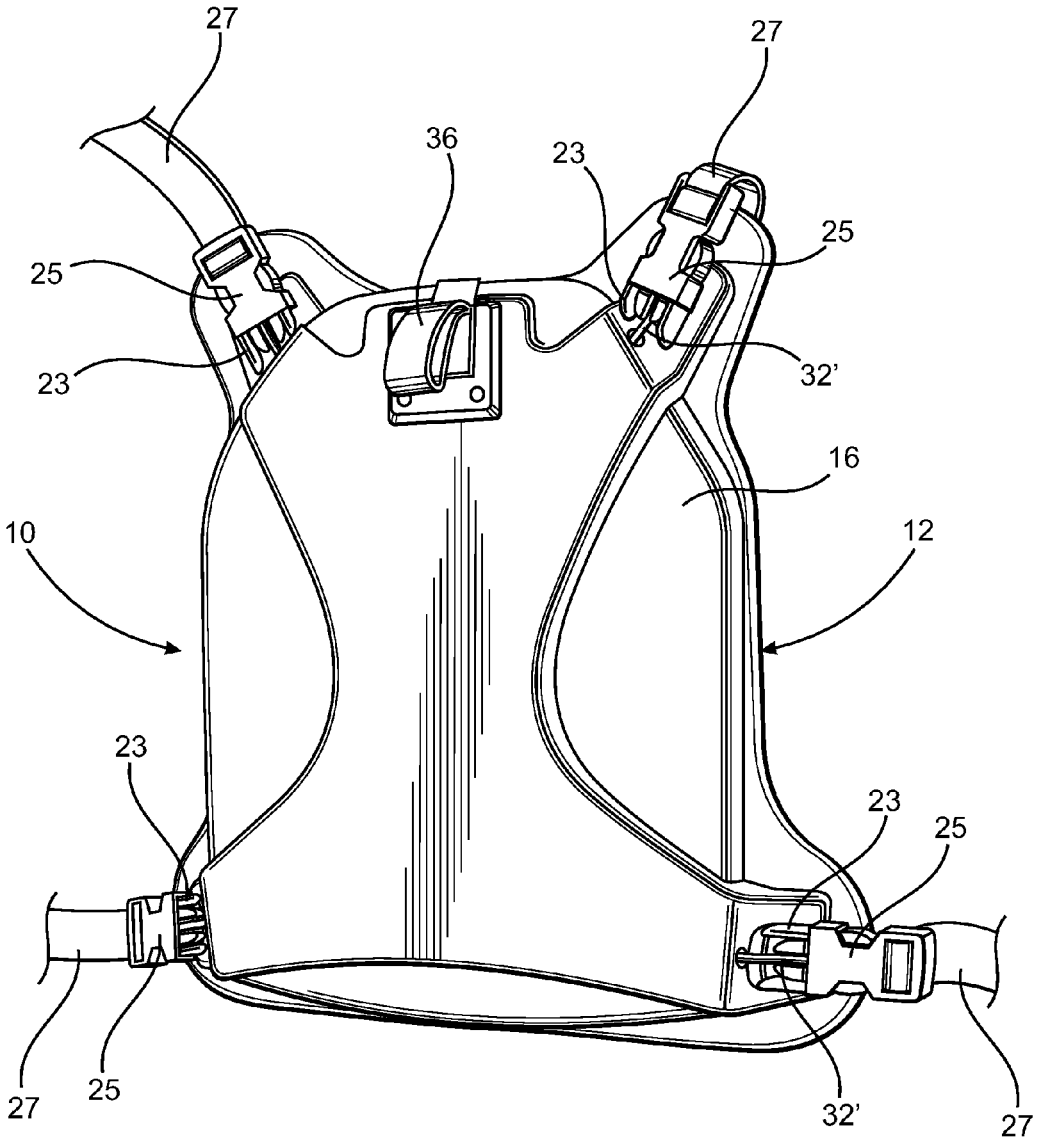
FIG. 1 is a front perspective view of one preferred embodiment of the armor holder assembly of the present invention.

Further with regard to the inner portion 18, as at least partially represented in FIGS. 3 and 4, the base 12 may include an at least partially recessed cavity generally indicated as 24. The cavity 24 is structured to retain the armor structure 20, whether or not it is in the form of an armor plate, at least partially on the interior of the base 12. Accordingly, both the outer portion 16 and the inner portion 18 are cooperatively structured to define an at least partially recessed cavity 24. The cavity 24 is structured to facilitate the retention and support of the armor structure or armor plate 20 at least partially within the interior of the base 12. Interior space within the cavity 24 and or other parts of the inner portion 18 will be sufficient to accommodate the armor structure 20 within the cavity 24, due at least in part to the outward protrusion or "bulging" of the outer portion 16 in the manner clearly represented in FIGS. 1 and 2.

In addition, the cavity 24 may include at least an inner peripheral surface or portion 26 which engages and thereby facilitates the support and retention of the armor structure or armor plate 20 on the inner portion 18 of the base 12. Therefore, the outer periphery or outer peripheral portion 20' of the armor structure 20 may correspond, at least in part, to the inner peripheral portion or peripheral surface 26. This serves to accomplish the at least partial enclosure of the armor structure or armor plate 20 within the cavity 24 and at least partially within the interior of the base 12. When so disposed, the armor structure or armor plate 20 has its outer surface substantially flush or extending minimally outward from the open face of the cavity 24, wherein the open face of the cavity 24 may be at least partially defined by the inner periphery or peripheral surface 26. Such a disposition of the armor structure 20 will facilitate a comfortable, operative mounting of the base 12 on the user when the holder assembly 10 is worn in its intended, protective orientation. It should be further noted that padding or cushioning material may be disposed in at least partially overlying relation to the outer face or surface of the armor structure or armor plate 20, as well as exposed portions of the remainder of the inner portion 18 of the base 12.

As set forth above, the armor holder assembly 10 also includes an attachment assembly generally indicated as 22 which facilitates the reliable, but preferably removable, operative mounting of the base 12 and armor structure 20 in the aforementioned "protective orientation" on the user. In more specific terms, the attachment assembly 22 comprises a plurality of connectors 23 attached to the base 12 at spaced locations from one another. In at least one embodiment, each of the plurality of connectors 23 may include a "quick-release" structure such as, but not limited to, a quick release connector of the type disclosed in U.S. Pat. No. 9,038,251 to the inventor herein. Moreover, whether each or at least some of the plurality of connectors 23 assume the quick-release structure and/or capabilities, each of the connectors 23 is operative to be removably secured to a cooperatively disposed and structured buckle or connector 25. Each of the plurality of connectors or buckles 25 may be associated with a strap, belt, harness, etc. 27 which may be a part of the gear, apparel, garment, etc. worn by or secured to the user's body.

In addition to the plurality of connectors 23, the attachment assembly 22 also comprises a release assembly generally indicated as 30 in FIG. 4. As represented, the release assembly 30 includes at least one but preferably a plurality of cables, cords or the like 32, which operatively interconnect each or a predetermined number of the plurality of connectors 23 to a common release mechanism 34. While at least a portion of the common release mechanism 34 is disposed on or in combination with the inner portion 18, it also includes a handle or like gripping structure 36 exteriorly accessible on the base 12 preferably, but not exclusively adjacent the outer portion 16. Further, the gripping structure 36 is disposed on the exterior of the base 12 in a location which is easily and quickly accessible by the user on which the armor holder assembly 10 is operatively mounted. Accordingly, operative interconnection between the common release mechanism 34 and the plurality of cables 32 will result in a substantially concurrent release of the connectors 23 or there concurrent disposition into a release orientation. When so released, the plurality of connectors 23 will be substantially immediately disconnected from corresponding ones of the connector or buckles 25.

Moreover, by virtue of the release assembly 30 and accompanying common release mechanism 34, the base 12 can be quickly, easily and reliably removed from its operative mounting on the body of the user, such as in emergency or other appropriate situations. It is further noted that the gripping structure 36 may be in the form of a flexible strap or like handle, as clearly represented in FIGS. 1 and 2 or may assume a variety of other structural and operative features. In use, a pulling force or other appropriate directional force may be exerted on the gripping structure 36 associated with the common release mechanism 34 thereby serving to concurrently release each of the connectors 23 from corresponding ones of the connectors or buckles 25. Further, while the specific structural and operative features of each of the plurality of connectors 23 may vary, it is noted that an operative distal end as at 32' (see FIG. 1) of the cables, cords, etc. 32 may extend outwardly from interior portions of the base 12. Also, a comparison of FIGS. 3 and 4 indicates that in at least one embodiment the plurality of interconnecting, operative cables 32 may be disposed "beneath" the armor structure or armor plate 20 and the cover structure 19 in sandwiched but movable disposition between the interior surface of the armor structure 20 and the interior surface of the cavity 24 and or inner portion 18.

Yet another preferred embodiment of the armor holder assembly is generally indicated as 110 and represented in FIGS. 6 through 10. With initial reference to FIGS. 6 and 7 the holder assembly 110 includes many of the structural components as appears in the embodiments of FIGS. 1-5. More specifically, the holder assembly 110 includes a base 12 having an outer portion 16 and an inner portion 18 as well as a recessed cavity 24. Further, an armor structure 20 and a cover structure 19 are disposed in substantially adjacent relation to one another when assembled. As a result, the assembled holder assembly 110 will be similar in appearance and overall structural configuration as that represented in FIGS. 1-4.

However, the armor holder assembly 110 further includes an intermediate structure 120 disposed adjacent to the armor structure 20 and further disposed substantially between the base 12 and the armor structure 20 in an at least partially sandwiched relation. Also, similar to the embodiments of FIGS. 1-5 and as set forth above a completed assembled armor holder assembly 110 will have the appearance and overall structural configuration of the embodiments of FIGS. 1 through 5. As such, the intermediate structure 120, the armor structure 20 and the cover 19 will be at least partially disposed within or in contiguous relation to the inner portion 18 and at least partially disposed within the recessed cavity 24 of the base 12.

As also represented in FIG. 6-10 the attachment assembly 22 is operatively mounted on the intermediate portion 120. As such, the various components of the attachment assembly are movably and/or operatively disposable relative to one another to facilitate the attachment of the armor holder assembly 110 to the body of the user and the quick removal or release of the armor holder assembly 110 from the user, when desired. Therefore, the attachment assembly 22 includes all of the components as represented in the embodiments of FIGS. 1-5 and differs primarily by being mounted on the outer surface 122 of the intermediate structure 120.

Figure 7:
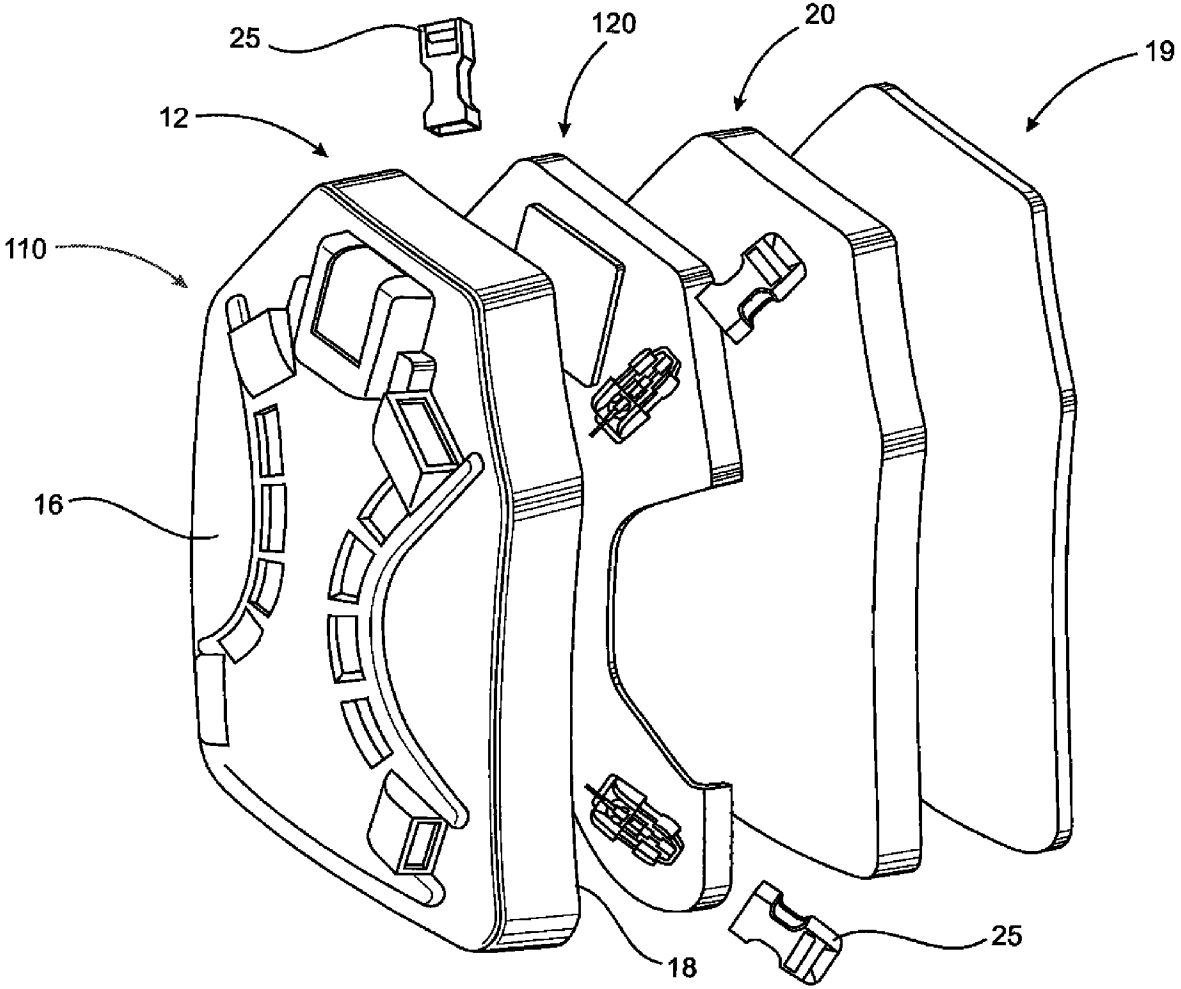
FIG. 7 is a rear composite perspective view of the preferred embodiment of FIG. 6.
Figure 8:
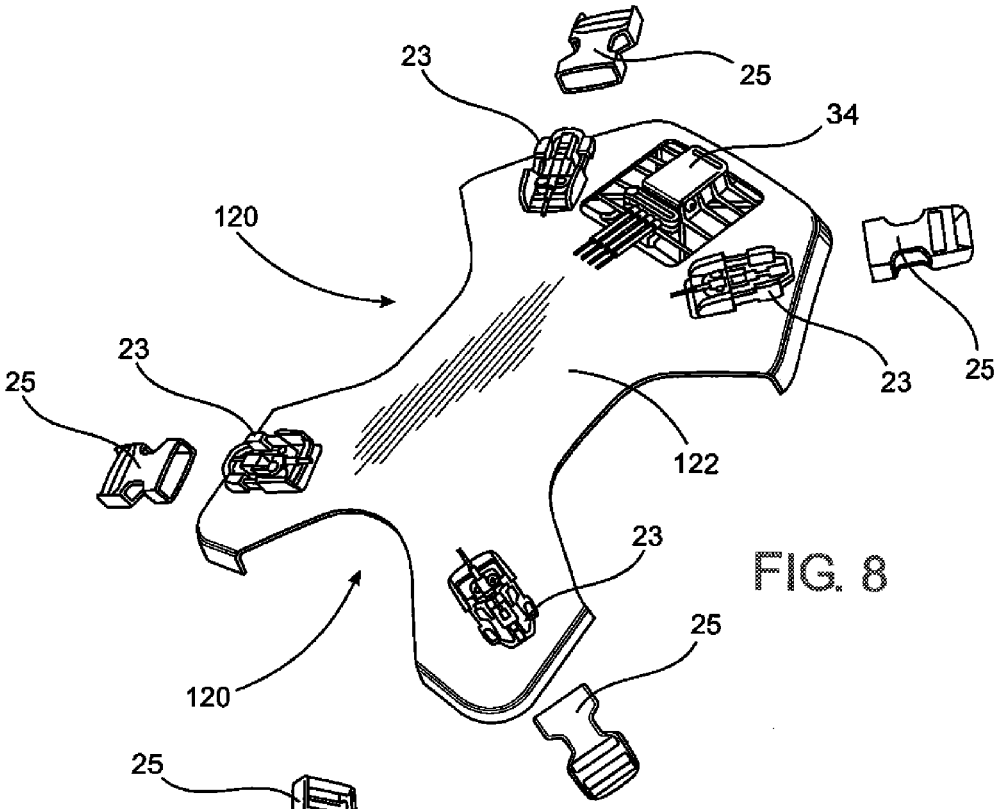
FIG. 8 is a top rear perspective view in partially exploded form of an intermediate structure associated with the embodiment of FIGS. 4-7.
Figure 9:
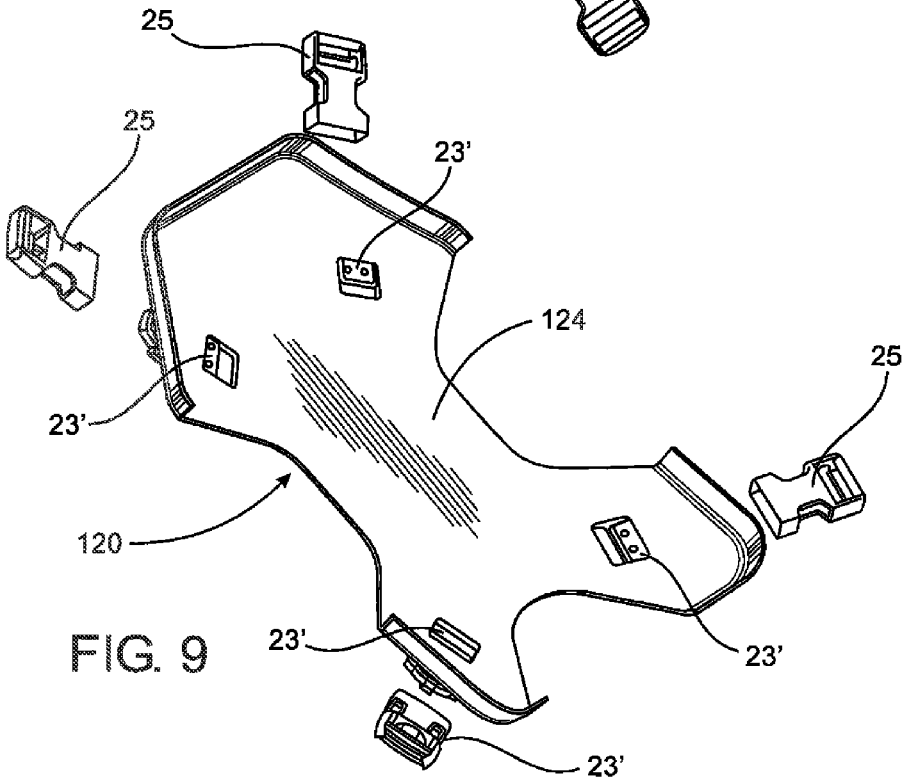
FIG. 9 is a top front perspective view in partially exploded form of the intermediate structure of the embodiment of FIG. 8.

For purposes of clarity the outer surface 122 and the inner surface 124 are respectively disposed in facing relation to the base 12 and inner portion 18 thereof and the armor structure 20, as clearly represented in FIGS. 7 and 8. Additional structural features of the intermediate portion 120 include its configuration into a substantially outwardly beveled, domed, curved or like shape. As such this outwardly bowed configuration facilitates its connection to the base 12 contiguous with the inner portion 18 and at least partially disposed within the recessed cavity 24 of the base 12.

Further, for purposes of clarity it is emphasized that in the additional preferred embodiment of FIG. 6-10 the base 12, armor structure 20 and cover 19 are herein described and defined as being structurally equivalent in dimension, configuration, material and operative features as the base 12, armor structure 20 and cover 19 described with reference to the embodiments of FIGS. 1-5.

As set forth above, the armor holder assembly 110 also includes an attachment assembly generally indicated as 22 mounted on or connected to the intermediate portion 120. As such the attachment assembly 22 facilitates the reliable, but preferably removable, operative mounting of the base 12, armor structure 20, in the aforementioned "protective orientation" on the user. In more specific terms and in accord with the attachment assembly 22 associated with the embodiments of FIGS. 1-5, the attachment assembly 22 of the additional preferred embodiment of FIGS. 6-10 comprises a plurality of connectors 23 attached to the outer face or surface 122 of the intermediate portion 120 at spaced locations from one another. Further, each of the plurality of connectors 23 may include a "quick-release" structure such as, but not limited to, a quick release connector of the type disclosed in presently pending U.S. Pat. No. 9,038,251 to the inventor herein. Moreover, whether each or at least some of the plurality of connectors 23 assume the quick-release structure and/or capabilities, each of the connectors 23 is operative to be removably secured to a cooperatively disposed and structured buckle or connector 25. As represented in the embodiments of FIGS. 1-5, each of the plurality of connectors or buckles 25 may be associated with a strap, belt, harness, etc. 27 which may be a part of the gear, apparel, garment, etc. worn by or secured to the user's body. Further, the relative positions, shapes, sizes, etc. of the intermediate structure 120 and at least the base 12 facilitate attachment of the connectors 25 to the connectors 23 generally about and or long an outer periphery of the intermediate structure 120.

Figure 2:
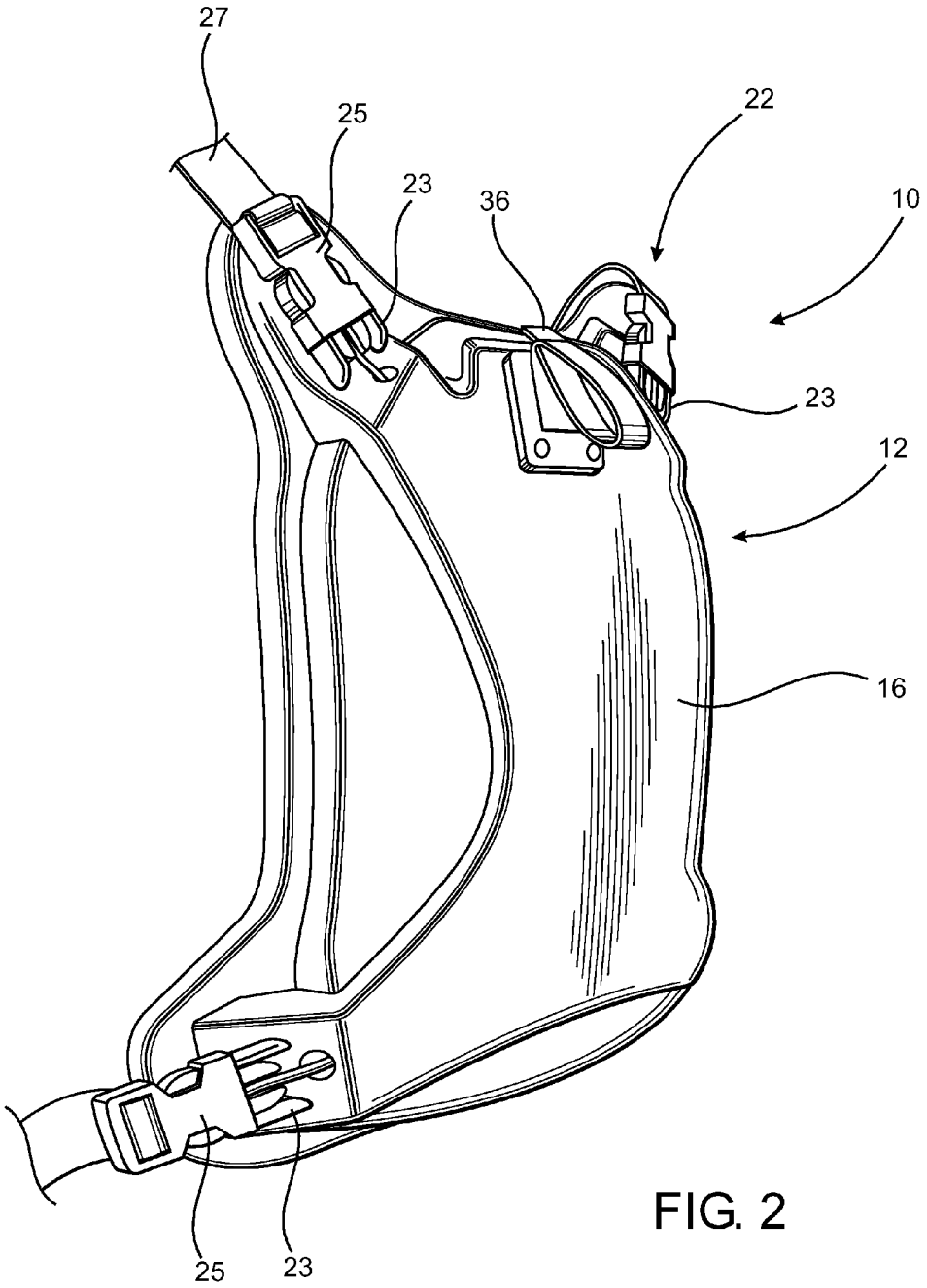
FIG. 2 is an additional front perspective view of the embodiment of FIG. 1.
Figure 10:
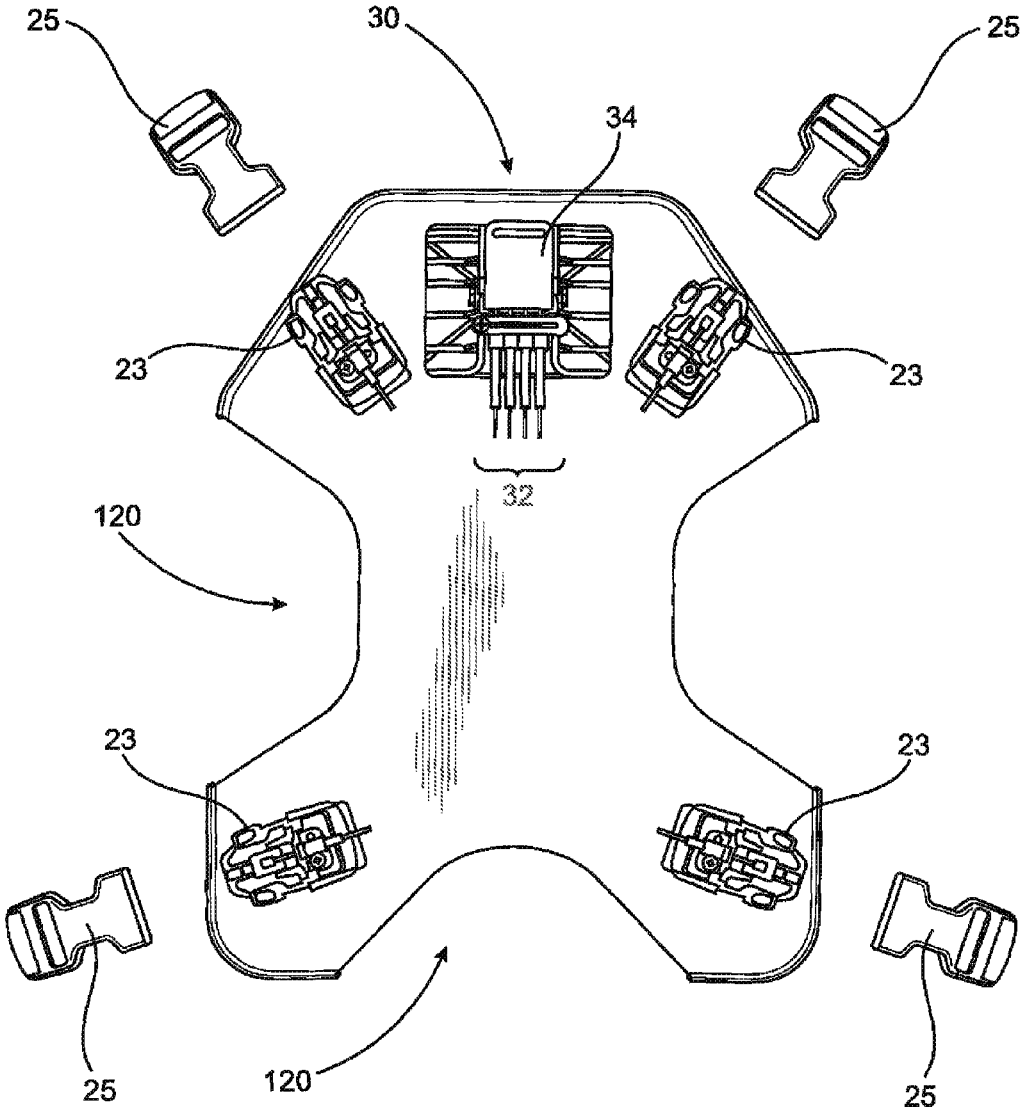
FIG. 10 is a front elevation in partially exploded form of the embodiment of FIGS. 8-9.

In addition to the plurality of connectors 23, the attachment assembly 22 also comprises a release assembly generally indicated as 30 in FIGS. 8 and 10. As represented, the release assembly 30 includes at least one but preferably a plurality of cables, cords or the like 32, which operatively interconnect each or a predetermined number of the plurality of connectors 23 to a common release mechanism 34, as is present in the holder assembly 110 but represented in greater detail in FIG. 4. While at least a portion of the common release mechanism 34 is disposed on or in combination with the outer surface 122, it also includes a handle or like gripping structure 36 (see FIG. 7) extending outwardly from both the intermediate structure 120 and the base 12 similar and functionally equivalent to the embodiment represented FIG. 2. As such, the gripping structure 36 is exteriorly accessible preferably, but not exclusively, as represented in FIG. 2, which extends adjacent the outer periphery of the base 12 and outer portion 16, when the armor holder assembly 110 is fully assembled in the manner represented in FIG. 2. Further, the gripping structure 36 is disposed in a location which is easily and quickly accessible by the user on which the armor holder assembly 110 is operatively mounted. Accordingly, operative interconnection between the common release mechanism 34 and the plurality of cables 32 will result in a substantially concurrent release of the connectors or there concurrent disposition into a release orientation. When so released, the plurality of connectors 23 will be substantially immediately disconnected from corresponding ones of the connector or buckles 25.

Moreover, by virtue of the release assembly 30 and accompanying common release mechanism 34, the base 12, including the intermediate structure 120, the armor structure 20 and the cover member 19, can be quickly, easily and reliably removed from its operative mounting on the body of the user, such as in emergency or other appropriate situations. It is further noted that the gripping structure 36 may be in the form of a flexible strap or like handle, as clearly represented in FIGS. 1 and 2 or may assume a variety of other structural and operative features. In use, a pulling force or other appropriate directional force may be exerted on the gripping structure 36 associated with the common release mechanism 34 thereby serving to concurrently release each of the connectors 23 from corresponding ones of the connectors or buckles 25. Further, while the specific structural and operative features of each of the plurality of connectors 23 may vary, it is noted that an operative distal end as at 32' of the cables, cords, etc. 32 may extend outwardly from interior portions of the base 12. Also, the plurality of interconnecting, operative cables 32 may be disposed between the inner portion 18 and/or cavity 24 and the outer face 122 of the intermediate structure 120 in sandwiched but movable disposition between the outer surface 122 of the intermediate portion 120 and the interior surface of the cavity 24 and or inner portion 18.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly structured for mounting armor on the body of a user, said assembly comprising:

a base formed of a rigid material and including an outer portion and an inner portion, an armor structure connected to said base and being at least partially formed of ballistic armor, said base structured to protect said armor structure from impacts other than an encounter with a projectile, an intermediate structure connected to said base substantially adjacent and between said inner portion and said armor structure, an attachment assembly mounted on said intermediate structure and structured to facilitate operative mounting and removal of said base and said armor structure on the user, in and from a protective orientation, said attachment assembly comprising a plurality of connectors disposed on said intermediate structure and collectively structured to facilitate the operative mounting of said base in said protective orientation on the user, said plurality of connectors structured for removable attachment of said base from the operative mounting on the user, and said attachment assembly further comprising a release assembly mounted on said intermediate structure in interconnected relation to said plurality of connectors and structured for substantially concurrent release of said plurality of connectors.

2. An attachment assembly as recited in claim 1 wherein said rigid material of said outer portion comprises a rigid plastic material.

3. The attachment assembly as recited in claim 2 further comprising a cover structure comprising an armor composite material.

4. The assembly as recited in claim 1 further comprising a cover structure comprising an armor composite material.

5. The assembly as recited in claim 1 wherein said release assembly comprises a common release mechanism mounted on said base and interconnected to said plurality of connectors.

6. The assembly as recited in claim 5 wherein said common release mechanism is operative to substantially concurrently dispose said plurality of connectors in a released orientation.

7. The assembly as recited in claim 6 wherein said release assembly includes a cable assembly operatively interconnecting said common release mechanism to said plurality of connectors.

* * * * *